United States Patent [19]

Wologodzew

[11] Patent Number: 4,470,530

[45] Date of Patent: Sep. 11, 1984

[54] REMOVABLE MAILING MACHINE TAPE MODULE

[75] Inventor: Leo Wologodzew, Huntington, Conn.

[73] Assignee: Pitney Bowes Inc., Stamford, Conn.

[21] Appl. No.: 477,096

[22] Filed: Mar. 21, 1983

[51] Int. Cl.[3] ..... B65H 9/08; B65H 17/20

[52] U.S. Cl. ..... 226/165; 225/16; 225/82; 226/127

[58] Field of Search ..... 225/51, 52, 73, 74, 225/75, 82, 84, 6, 10, 11, 16; 242/55.53, 55.3; 226/154, 127, 128, 165, 87, 90, 91; 101/382 R, 92, 37

[56] References Cited

U.S. PATENT DOCUMENTS

| | | | |
|---|---|---|---|
| 766,266 | 8/1904 | Krauth | 225/82 X |
| 1,114,912 | 10/1914 | Richards | 226/154 X |
| 1,173,795 | 2/1916 | Goldberger et al. | 225/82 X |
| 2,611,432 | 9/1952 | Tallman | 225/57 X |
| 3,163,446 | 12/1964 | Muncy | 226/128 X |
| 3,625,407 | 12/1971 | Norman | 226/127 X |

FOREIGN PATENT DOCUMENTS

| | | | |
|---|---|---|---|
| 7322731 | 2/1975 | France | 225/16 |

*Primary Examiner*—Stuart S. Levy
*Assistant Examiner*—Leo J. Peters
*Attorney, Agent, or Firm*—Lawrence E. Sklar; William D. Soltow, Jr.; Albert W. Scribner

[57] ABSTRACT

A mailing machine including a postage meter for printing postage impressions on tape, a removable tape dispensing module, and a device for receiving the removable tape dispensing module. The removable tape dispensing module includes a support housing, a shaft translatably mounted in the housing, an advance roller slidably mounted on the inner end of and rotatably with the shaft, a paddle pivotably mounted on the housing and biased downwardly onto the advance roller to thereby clamp the tape, a cam fixedly mounted on the interior portion of the shaft, the cam being engagable with the paddle to lift the paddle away from the advance roller, a rotatable knob mounted on the outer end of the shaft and capable of rotating the advance roller, and a device for effecting translation of the cam in the direction of the axis of the shaft.

5 Claims, 4 Drawing Figures

FIG. 3
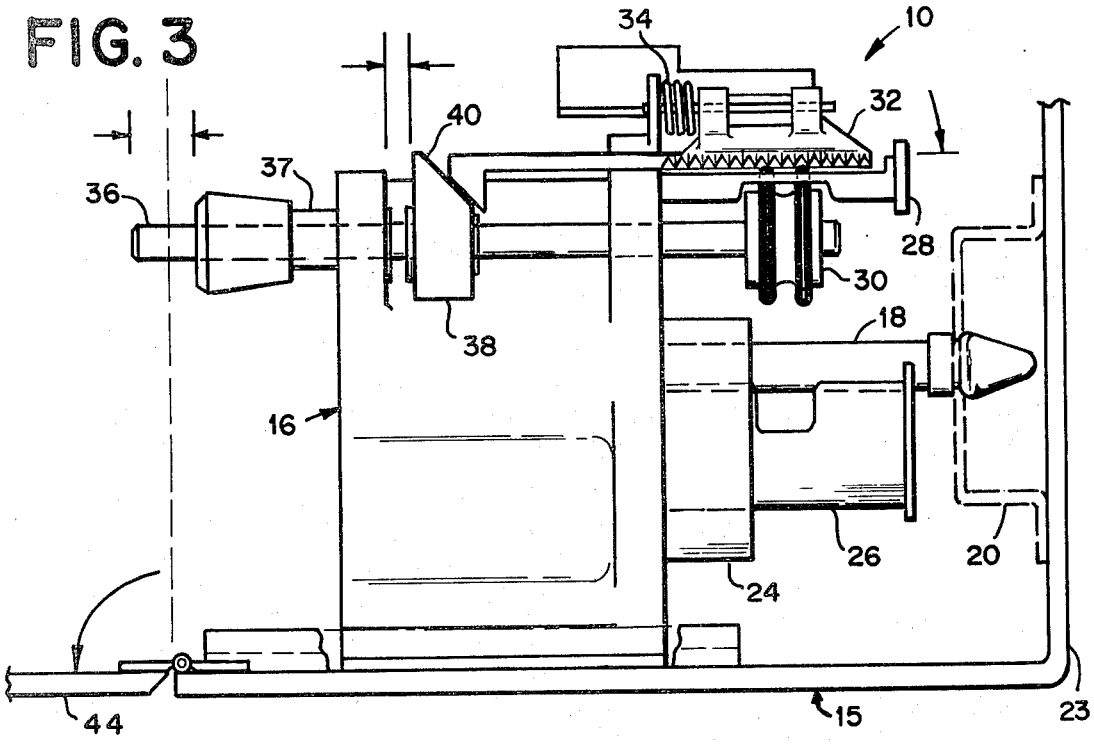
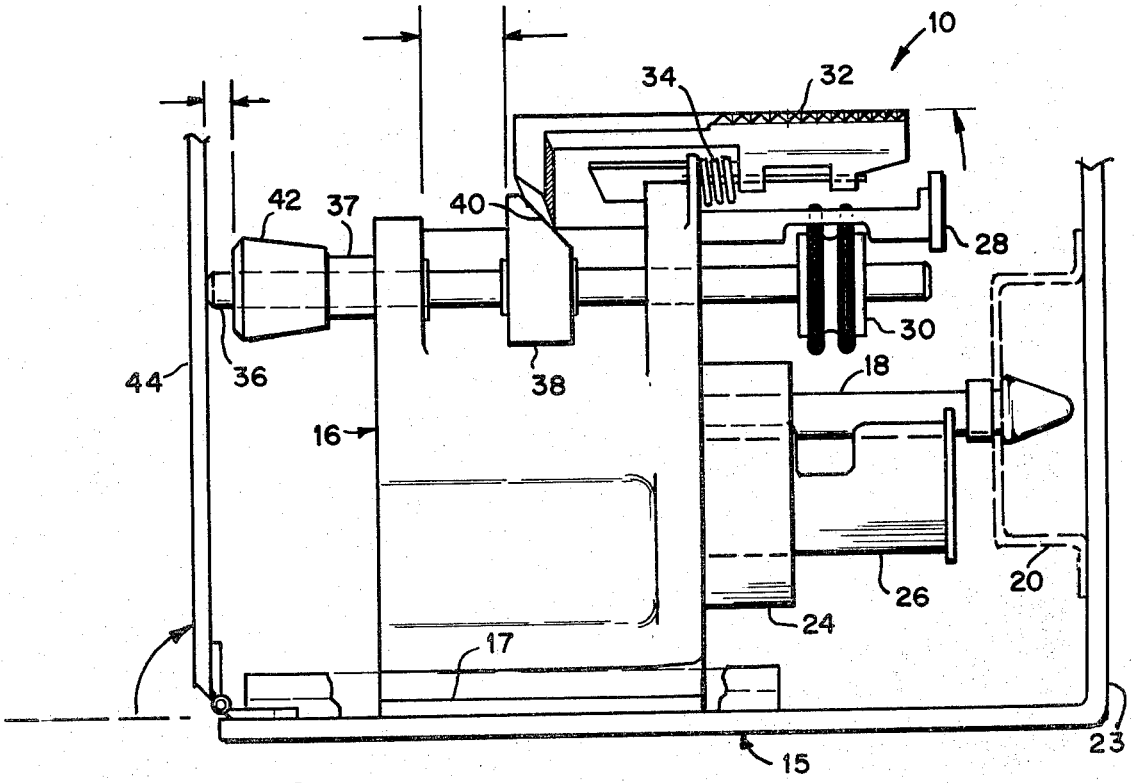
FIG. 4

REMOVABLE MAILING MACHINE TAPE MODULE

BACKGROUND OF THE INVENTION

The instant invention relates to mailing machines and more particularly to a tape dispensing module which is removable from the mailing machine for purposes of loading tape into the module.

In mailing machines having postage meters therein, provisions are made for the printing of a postage indicia on tape as well as on envelopes. For the most part, such machines are used primarily for the printing of envelopes and the leading end of the tape is maintained out of the path of travel of the envelope through the printing station. When a printed tape strip is desired, the movement of the tape from its normal position of rest must be in timed relation to the cyclic rotation of the postage meter print drum bearing the postage indicia, so that the printed indicia will be properly positioned on the tape when the tape is severed to form the strip. Positive control of the tape to maintain this relationship between the movement of the tape and rotation of the print drum is also necessary to ensure a complete and legible postmark impression with each machine operation.

Loading of the tape into the mailing machine has posed many problems for the user of the mailing machine. In many mailing machines, the tape has to be loaded directly into the machine, which, owing to its size and configuration, makes installation of the tape into the machine and positioning of the lead end of the tape in proper starting orientation a difficult procedure. There are machines which include tape housings which slide or swing out from the mailing machine, which facilitates installation of the tape, but orienting and maintaining the lead end of the tape in proper starting position still remains a problem.

The instant invention therefore provides a removable tape dispensing module which overcomes all of the foregoing problems associated with loading and orienting tape into a mailing machine by being completely removable from the mailing machine and by incorporating therein a device for clamping the lead end of the tape when the module is outside the mailing machine.

SUMMARY OF THE INVENTION

Accordingly, the instant invention provides a mailing machine including a postage meter for printing postage impressions on tape, a removable tape dispensing module, and means for receiving the removable tape dispensing module. The removable tape dispensing module comprises a support housing, a shaft translatably mounted in the housing, an advance roller slidably mounted on the inner end of and rotatably with the shaft, a paddle pivotably mounted on the housing and biased downwardly onto the advance roller to thereby clamp the tape, a cam fixedly mounted on the interior portion of the shaft, the cam being engagable with the paddle to lift the paddle away from the advance roller, a rotatable knob mounted on the outer end of the shaft and capable of rotating the advance roller, and means for effecting translation of the cam in the direction of the axis of the shaft.

BRIEF DESCRIPTION OF THE DRAWINGS

FIG. 3 is a side, elevational view of the tape dispensing module seen in FIG. 1 without any tape;

FIG. 4 is the same as FIG. 3 except it shows the cam translated to the right to move the paddle up and away from the advance roller.

DETAILED DESCRIPTION

Figure 1:
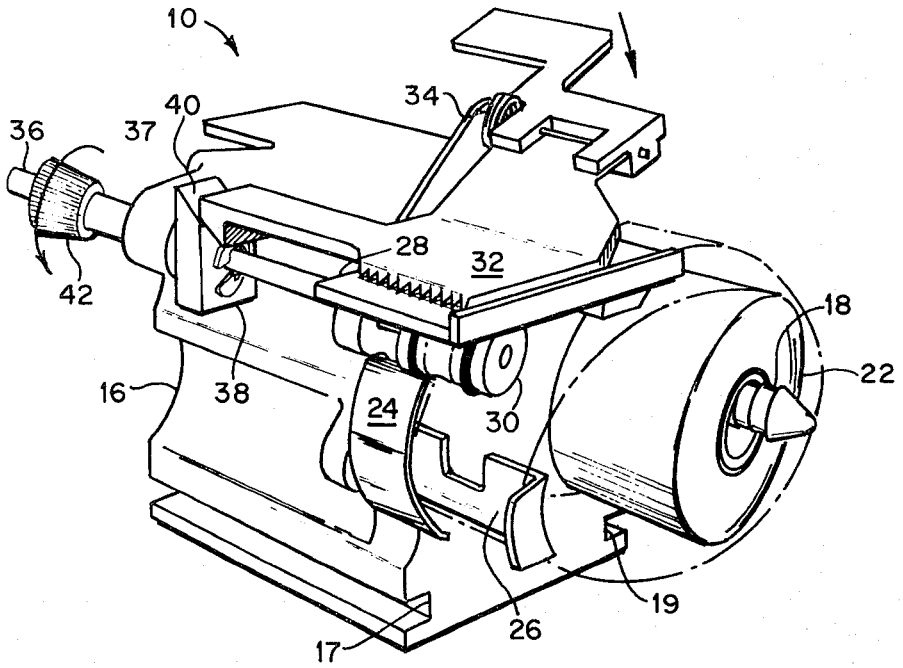
FIG. 1 is a perspective view of the tape dispensing module according to the instant invention separate from any mailing machine.

In describing the instant invention, reference is made to the drawings, wherein there is seen a tape dispensing module generally designated 10 mounted on a pair of guide rails 12 and 14 situated in a mailing machine 15. The tape dispensing module 10 includes a housing 16 which can be conveniently installed or removed from the mailing machine by sliding a pair of channels 17 and 19 respectively on the guide rails 12 and 14. The dispensing module 10 also includes a shaft 18 the inner end of which engages a retainer 20 (see FIGS. 3 and 4) seated in a sidewall 23 of the mailing machine 15. A roll of tape 22 is supported by the shaft 18, and the module 10 is removed from the mailing machine when a new roll of tape 22 is mounted on the shaft 18, thereby making installation of the tape 22 simple and convenient.

After the roll of tape 22 is mounted on the shaft 18 the lead end of the tape 22 is wound between an outer guide shield 24 and an inner guide shield 26, around the roll 22 and over a rectangular shroud 28 and an advance roller 30 and under a paddle member 32 which is biased downwardly against the advance roller 30 and the rectangular shroud 28 by means of a torsion spring 34 (see FIG. 1). The lead end of the tape 22 is thereby held in a stationary position by being pinched between the shroud 28 and the paddle member 32. The advance roller 30 is slidably mounted on the inner end of a rotatable, D-shaped, translatable shaft 36, to be discussed further herein below. The shroud 28 includes an opening 37 (see FIGS. 3 and 4) through which the advance roller 30 is projected in order to engage and advance the tape 22.

A camming plate 38 having a camming surface 40 is mounted on the translatable shaft 36. A knob 42 is mounted on the rotatable shaft 36 with a sleeve 37 such that rotation of the knob 42 will cause rotation of the shaft 36 but translation of the shaft 36 will not effect translation of the knob 42. When a new roll of tape 22 is installed on the shaft 18, the module 10 is remote from the mailing machine, and the camming plate 38 is urged into the position shown in FIGS. 1–3 by the weight of the paddle member 32 exerting a downward force which effects a downward force on the camming surface 40 which results in the camming plate 38 being moved out from under the paddle member 32. In this position, the paddle member 32 can effect a pinching action on the lead end of the tape 22 against the advance roller 30 and the rectangular shroud 28, and thereby assure that the lead end of the tape roll 22 will be in proper position when the module 10 is inserted into the mailing machine.

Figure 2:
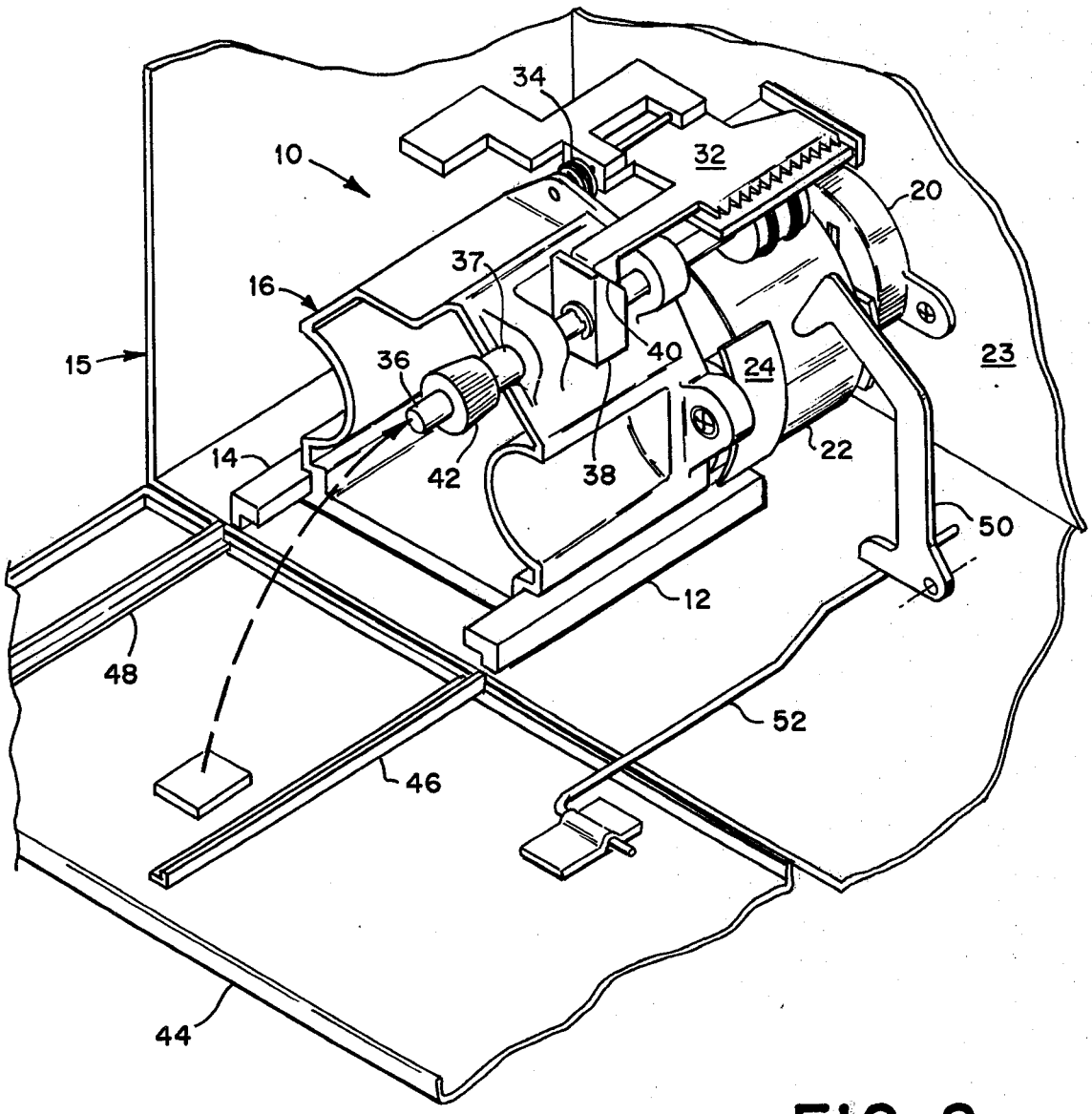
FIG. 2 is a perspective view of the tape dispensing module seen in FIG. 1 mounted in a mailing machine but showing the module oriented substantially perpendicular to the position seen in FIG. 2.

Once the tape roll 22 is mounted in the module 10 and the lead end of the roll 22 is clamped by the paddle member 32, the module 10 is ready for installation in the mailing machine. As best seen in FIG. 2, the mailing machine includes a rotatable door 44 which has a pair of guide tracks 46 and 48 for assisting in aligning the module 10 prior to insertion into the mailing machine. When the door 44 is in the open position, as shown in FIGS. 2 and 3, the module 10 can be set on the guide tracks 46 and 48 by locating the guide rails 12 and 14 of the module 10 on the guide tracks 46 and 48 respectively. The module can then be slid into the position shown in the drawings. The mailing machine includes an end of tape sensor 50 (see FIG. 2) which is pivoted out of engagement with the tape roll 22 by a supporting rod 52 when the door 44 is in the open position and which is pivoted into sensing engagement against the roll of tape 22 when the door 44 is closed as seen in FIG. 4.

Whenever the door 44 is not pressing against the end of the shaft 36, the paddle member 32 pinches the lead end of the tape roll 22 against the shroud 28. Accordingly, the lead end of the roll of tape 22 is always secure during installation of the roll. Once the module 10 is completely inserted in the mailing machine, the door 44 is closed as seen in FIG. 4, which has the effect of urging the shaft 36 inward, which in turn causes the camming plate 38 to move inward and engage the beveled surface 54 of the paddle member 32. This camming action of the camming plate 38 on the paddle member 32 causes the paddle member 32 to be lifted. The advance roller 30 is not translated since it is slidably mounted on the shaft 36.

While the invention has been described with reference to the structures disclosed herein, it is not confined to the details set forth and this application is intended to cover such modification or changes as may come within the purpose of the improvements or the scope of the following claims.

What is claimed is:

1. A mailing machine, comprising:

A. a postage meter for printing postage impressions on tape;

B. a removable tape dispensing module having (i) a support housing, (ii) a shaft translatably mounted in said housing, (iii) an advance roller slidably mounted on the inner end of and rotatable with said shaft, (iv) a paddle pivotably mounted on said housing and biased downwardly onto said advance roller to thereby clamp the tape, (v) a cam fixedly mounted on the interior portion of said shaft, said cam being engagable with said paddle to lift said paddle away from said advance roller, (vi) a rotatable knob mounted on the outer end of said shaft and capable of rotating the advance roller, and (vii) means for effecting translation of said cam in the direction of the axis of said shaft; and C. means for receiving said removable tape dispensing module.

2. The mailing machine of claim 1, wherein the translation effecting means comprises a door rotatably secured to the mailing machine, whereby closure of the door effects movement of the paddle away from the advance roller, thereby allowing the advance roller to advance the tape.

3. The mailing machine of claim 2, wherein said receiving means includes a pair of guide rails, and the removable tape dispensing module includes a pair of channels for sliding engagement with said guide rails whereby the module is mounted in the mailing machine.

4. The mailing machine of claim 3, wherein the mailing machine door includes a pair of guide tracks for assisting in aligning the module prior to insertion in the mailing machine.

5. The mailing machine of claim 4, wherein the dispensing module additionally comprises a shroud located between the advance roller and the paddle, said shroud having an opening through which the advance roller is projected for engagement with the tape.

* * * * *